United States Patent [19]

Thompson

[11] 3,931,483

[45] Jan. 6, 1976

[54] MULTIPLE CIRCUIT CONTROL SWITCH HAVING ARTICULATED CASCADED OPERATING MECHANISM

[75] Inventor: Paige W. Thompson, Morrison, Ill.

[73] Assignee: General Electric Company, Fort Wayne, Ind.

[22] Filed: Jan. 15, 1974

[21] Appl. No.: 433,593

[52] U.S. Cl. ..... 200/1 R; 200/5; 200/18; 200/83 P; 337/311; 337/320; 337/324

[51] Int. Cl.[2] ..... H01H 9/00; H01H 37/38

[58] Field of Search ..... 200/1 R, 5 R, 6 A, 17 R, 200/18, 175, 83 A, 83 P, 83 S, 83 SA, 83 C, 83 R, 83 D, 153 T; 337/114–117, 311, 320, 324

[56] References Cited

UNITED STATES PATENTS

| | | | |
|---|---|---|---|
| 1,414,448 | 5/1922 | Windell | 236/68 |
| 1,867,870 | 7/1932 | Baker et al. | 338/28 X |
| 1,877,990 | 9/1932 | Schweitzer | 337/117 X |
| 2,064,163 | 12/1936 | Ileman | 337/313 |
| 2,200,995 | 5/1940 | Procter | 200/83 X |
| 2,427,900 | 9/1947 | Camilli et al. | 337/308 |
| 2,510,859 | 6/1950 | Black et al. | 200/83 X |
| 2,586,992 | 2/1952 | Rapuano | 200/18 X |
| 2,754,388 | 7/1956 | Beeman | 200/83 |
| 2,792,465 | 5/1957 | Lieberman | 200/1 X |
| 2,848,588 | 8/1958 | Hackman | 200/83 X |
| 3,235,692 | 2/1966 | Kucera | 337/311 X |
| 3,482,195 | 12/1969 | Jansson | 337/321 |
| 3,483,337 | 12/1969 | Johnstone et al. | 200/6 A |
| 3,701,962 | 10/1972 | Ball et al. | 200/18 X |
| 3,713,062 | 1/1973 | Butler et al. | 337/107 |
| 3,731,013 | 5/1973 | Nightengale | 200/6 A X |

FOREIGN PATENTS OR APPLICATIONS

| | | |
|---|---|---|
| 289,072 | 4/1968 | Australia |
| 1,143,894 | 11/1958 | Germany |

*Primary Examiner*—James R. Scott
*Attorney, Agent, or Firm*—Joseph E. Papin

[57] ABSTRACT

An electrical switch having a plurality of means adapted to be movable generally sequentially for switching power through the electrical switch. A plurality of means are adapted to be conjointly and relatively movable disposed in cascaded articulated relation between the switching means at least some of the movable means being conjointly movable relative to at least some of the others thereof for effecting the sequential operation of the switching means. Methods and a system for generally effecting sequential operation of the switching means are also disclosed.

45 Claims, 4 Drawing Figures

MULTIPLE CIRCUIT CONTROL SWITCH HAVING ARTICULATED CASCADED OPERATING MECHANISM

CROSS-REFERENCE TO RELATED APPLICATIONS

This application is related to patent application Ser. No. 433,594 filed Jan. 15, 1974 which is specifically incorporated herein by reference.

BACKGROUND OF THE INVENTION

This invention relates generally to electrical switches and in particular to those having switching means adapted to be sequentially actuated, methods for effecting sequential actuation of switching means, and a system for making a plurality of separate circuits.

In the past, various electrical switches having a plurality of means for switching power in the electrical switch were provided, and in some of these past electrical switches, the switching means were adapted to be sequentially operated. For instance, in German patent D.A.S. 1,143,894, two spring loaded switch arms are provided for sequential operation between their respective contacts in response to an increasing force applied generally centrally of an actuating lever drivingly engaged between the switch arms. A disadvantageous or undesirable feature of the German patent is that the switching arrangement is limited since it can operate only two switches.

Australian Pat. No. 289,072 discloses three snap-acting switches biased for sequential operation, and a generally centrally located rigid plate mounted on a force producing diaphragm is linked with the switches for simultaneously transmitting an actuating force thereto for effecting the sequential operation. One of the disadvantageous or undesirable features of this Australian patent is that the switches were arranged about the generally centrally located rigid plate wherein the number of switches capable of being sequentially operated by the rigid plate was necessarily limited if only by physical size of the structure. In other words, if an attempt was made to incorporate more switches for sequential operation, the complexity of the construction might, for all practical purposes, render it inoperable or at least undesirable from an economic and manufacturing viewpoint. Another disadvantageous or undesirable feature is that means for limiting motion of the switches was necessarily provided for each switch limiting further movement thereof in its actuated position when another switch associated therewith was moved to its actuated position.

In U.S. Pat. No. 3,701,962 there is shown a switching device which has a plurality of switch means sequentially operated by a wobble plate in response to a force applied thereto by a bimetal member adapted to be heated. However, it is believed that this construction has generally the same disadvantageous or undesirable features as discussed above with respect to the Australian patent.

SUMMARY OF THE INVENTION

Among the several objects of the present invention may be noted the provision of an electrical switch, methods of sequentially actuating a plurality of switching means, and a system for making a plurality of separate circuits which overcome the disadvantageous or undesirable features discussed above, as well as others, with respect to the prior art; the provision of such electrical switch, methods, and system in which snap-action is provided for each of the plurality of switching means thereof wherein contact force does not go to zero upon the opening of the contacts of the switching means; the provision of such electric switch, methods, and system having actuating means for the switching means which are disposed in an articulated cascaded relation between the switching means; the provision of such electric switch, methods, and system in which the actuating means for the switching means, in their articulated cascaded relation, are disposed generally in aligned row formation between the switching means; the provision of such electric switch, methods, and system in which the actuating means for the switching means, in their articulated cascaded relation, are disposed in tier formation between the switching means; the provision of such electric switch, methods and system wherein at least some of the components of the actuating means for the switching means are common; and the provision of such electrical switch which is simplistic in design, economical to manufacture, and easily assembled. Other objects and features will be in part apparent and in part pointed out hereinafter.

In general and in one form of the invention, an electrical switch has a plurality of means adapted to be movable generally sequentially for switching power through the electrical switch. A plurality of means are adapted to be cojointly and relatively movable and disposed in cascaded articulated relation between the switching means, and at least some of the movable means are conjointly movable relative to at least some of the others thereof for effecting the sequential operation of the switching means.

More particularly and in one form of the invention, the movable means include first and second levers drivingly engaged between first and second pairs of the switching means, one of the first and second levers being movable for sequentially operating the switching means of one of the first and second pairs thereof prior to movement of the other of the first and second levers for sequentially operating the switching means of the other of the first and second pairs thereof. Third and fourth levers are also drivingly engaged between the first and second levers and a third pair of the switching means, and the third lever is movable for sequentially operating one of the first lever and one of the switching means of the third pair thereof prior to movement of the fourth lever for sequentially operating one of the second lever and the other switching means of the third pair thereof. A fifth lever is drivingly engaged with the third and fourth levers for sequentially operating one thereof prior to the other in response to a force applied on the fifth lever.

In general and in one form of the invention, an electrical switch has a plurality of means adapted to be generally sequentially movable for switching power through the electrical switch. A plurality of means are disposed generally in cascaded articulated relation with each other between the switching means and are movable for actuating them generally sequentially, and means for applying a force of varying magnitude under preselected conditions onto the actuating means effects the switching means actuating movement thereof.

Also in general and in one form of the invention, there is provided a method for generally sequentially actuating a plurality of means for switching power in an electrical switch. In this method, a plurality of means is disposed generally in cascading articulated relation between the switching means for actuating engagement therewith, and a force is applied under preselected conditions to the actuating means for articulating them in a manner to distribute at least a portion of the force to each of the switching means for effecting the generally sequential actuation thereof.

In another form of the invention and also in general, there is provided a method for actuating a pair of sets of a plurality of means under preselected conditions for respectively switching power generally in sequence in an electrical switch. In this method, a variable force is established in response to the preselected conditions, and the variable force is distributed for sequentially actuating the plurality of switching means in one set thereof prior to sequentially actuating the plurality of switching means in the other set thereof.

Further and in general, a system in one form of the invention has a plurality of separate circuits, and a plurality of means respectively making the separate circuits to energize them generally sequentially. In combination therewith, there is also provided means for establishing a generally increasing force under preselected conditions. A plurality of means is disposed in cascaded articulated relation with each other and driven in response to the increasing force for predeterminately distributing at least portions thereof to preselected ones of the circuit making means thereby to effect the generally sequential energization of the circuits.

BRIEF DESCRIPTION OF THE DRAWINGS

Corresponding reference characters indicate corresponding parts throughout the several views of the drawings.

The following exemplifications set out herein illustrate the preferred embodiments of the invention in one form thereof, and such exemplifications are not to be construed as limiting in any manner the scope of the invention.

DESCRIPTION OF THE PREFERRED EMBODIMENT

Figure 1:
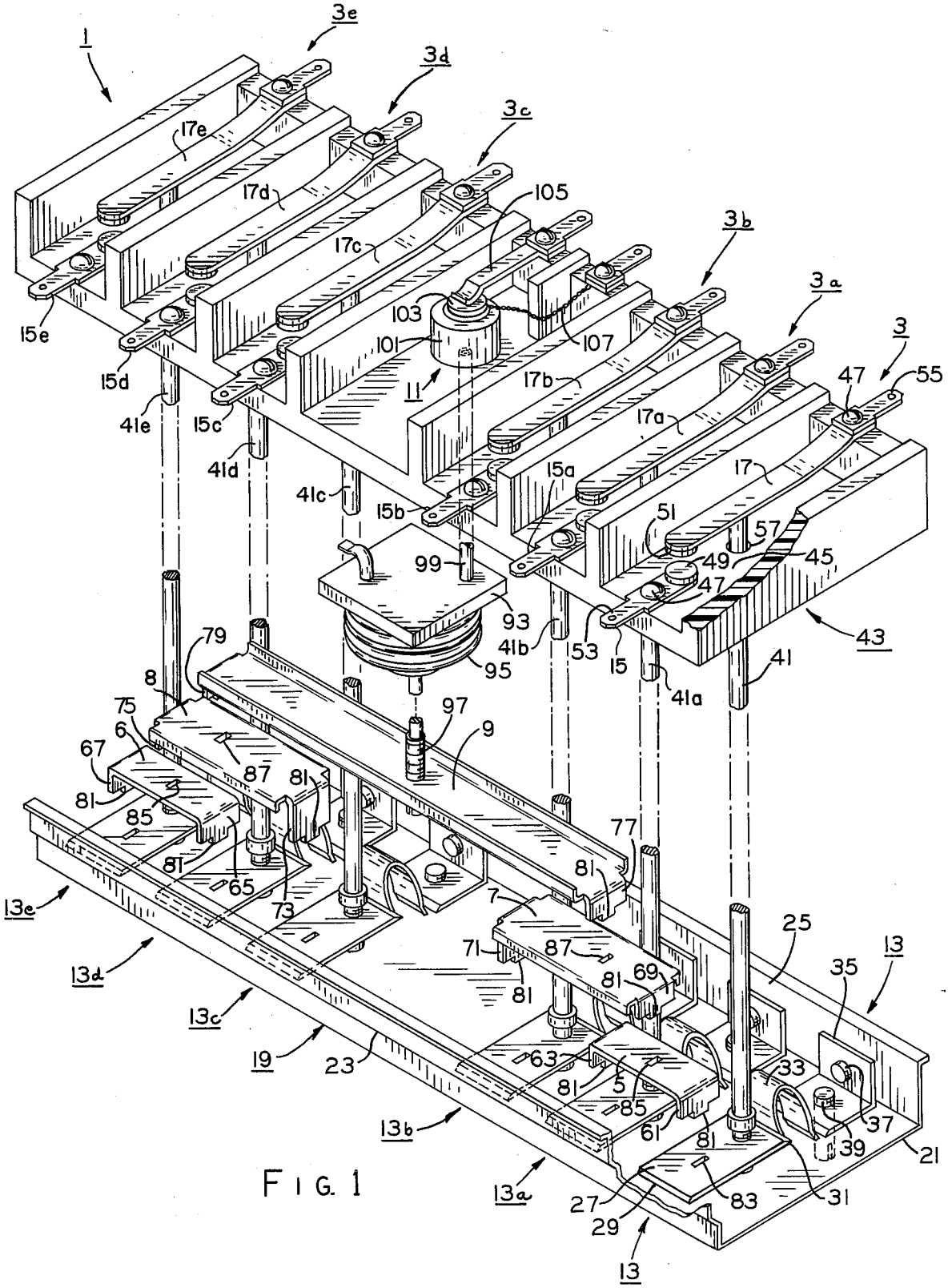
FIG. 1 is an exploded perspective view of an electrical switch of the present invention in one form thereof which illustrates methods for sequentially actuating a plurality of switching means in one form of the invention and also a system for making a plurality of separate circuits in the invention, respectively, in one form thereof.
Figure 2:
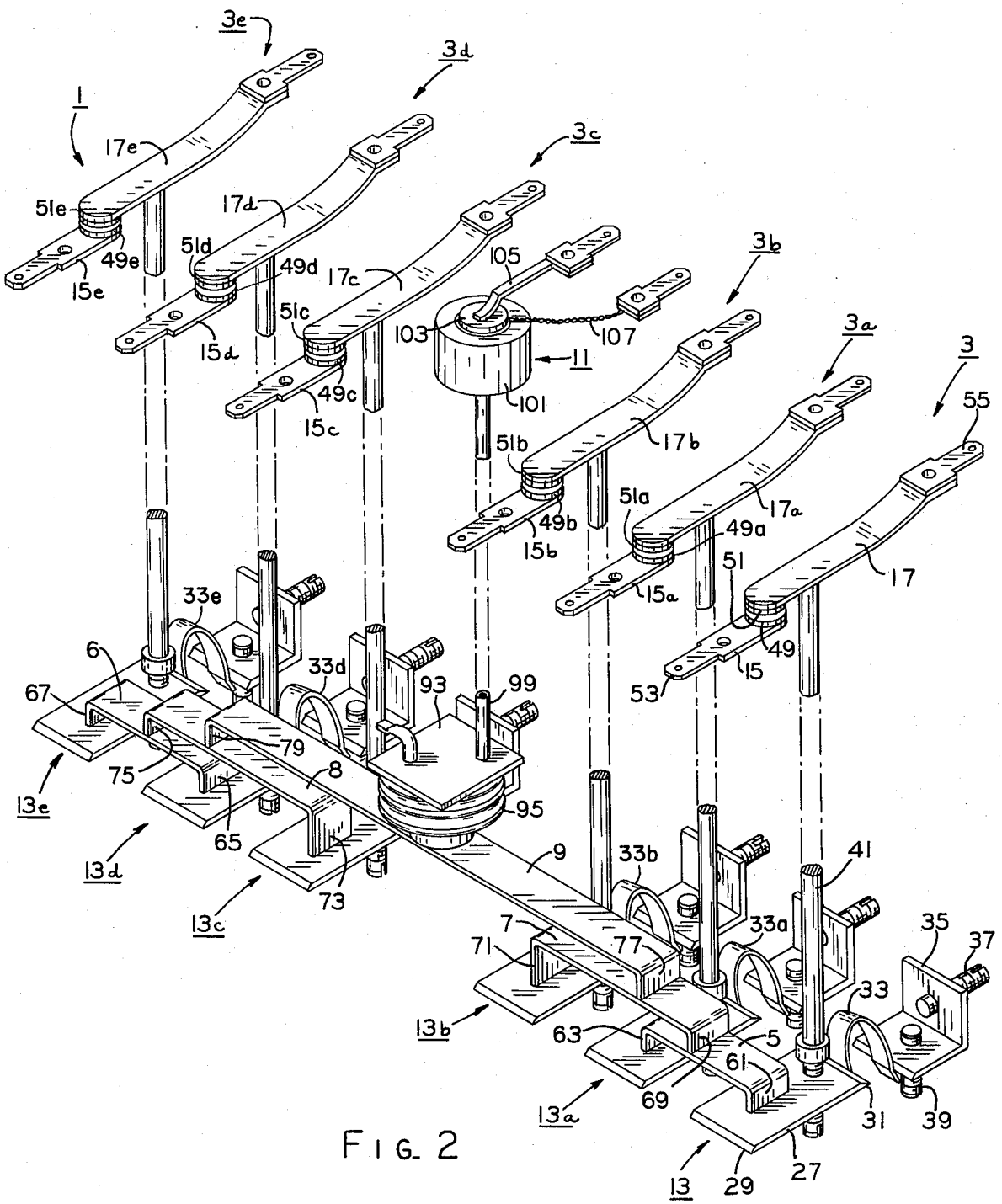
FIG. 2 is a schematic view of the electrical switch of FIG. 1 illustrating the articulated cascaded relation of the actuating means for the switching means of the electrical switch.
Figure 3:
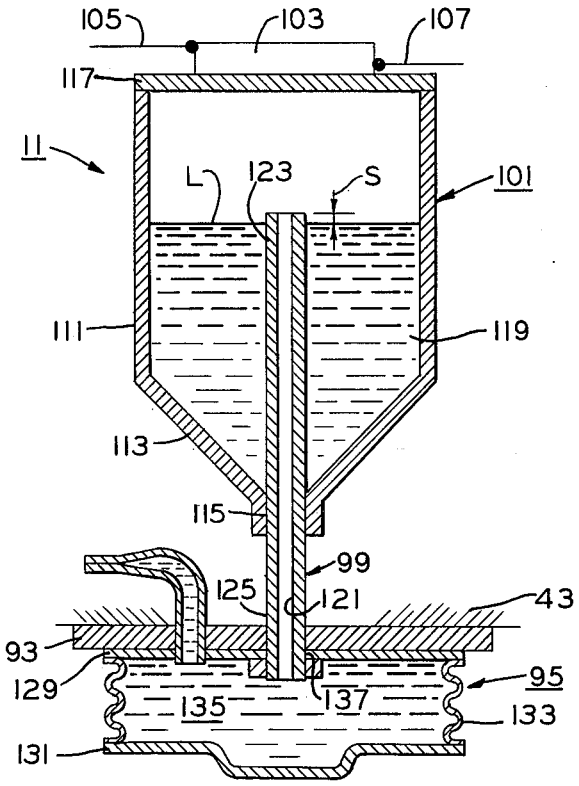
FIG. 3 is a schematic view of a thermal actuator illustrated in FIG. 1 for driving the actuating means of the electrical switch.

Referring now to the drawings in general, there is shown at 1 an electrical switch having a plurality of means, such as switches or switch assemblies indicated generally at 3, 3*a*, 3*b*, 3*c*, 3*d* and 3*e*, adapted to be generally sequentially actuated or movable for switching power through the electrical switch, FIGS. 1 and 2. A plurality of means, such as articulators or levers 5, 6, 7, 8 and 9, are disposed generally in articulated cascaded relation between switching means 3–3*e* and are movable for actuating the switching means generally sequentially. Means, such as a thermal actuator 11 also shown in FIG. 3, is effective for applying a force of varying magnitude under preselected conditions onto the actuating means or 5–9 levers to effect the switching means actuating movement thereof.

More particularly with reference to FIGS. 1 and 2 each of switching means 3–3*e* may include a like toggle device and a like pair of stationary and movable contact or switch operating members; however, for the sake of brevity and clarity only toggle device 13 and contact operating members 15, 17 will be described hereinafter, but the letter designation of the other switching means will be applied to their respective toggle devices and contact operating numbers when specific reference is made to them.

Electrical switch 1 is provided with a lower housing or frame 19 having a generally horizontally extending base 21 integrally interposed between a pair of generally vertically extending, opposite side walls 23, 25. Toggle device 13 is provided with an arm 27 having a pair of opposite ends 29, 31, and one end 29 is pivotally mounted to frame side wall 23 in a manner well known in the art while the other end 31 is pivotally connected to an end portion of a bent or generally U-shaped toggle spring 33. The opposite end portion of toggle spring 33 is pivotally connected to a generally L-shaped follower 35 which is adjustably or movably mounted in generally vertical and horizontal directions on lower frame 19 adjacent side wall 25 thereof. Follower 35 is adjustably engaged by means, such as an adjustment screw 37 or the like, for adjusting the differential between forces necessary to trip and reset toggle device 13, as further discussed hereinafter, and the adjustment screw is, in turn, captured in a slot (not shown) provided therefor in frame side wall 25, as is well known in the art. Upon rotation of adjustment screw 37, follower 35 is moved generally horizontally or parallel to frame base 21 to adjust the tension of toggle spring 33, and the toggle spring urges arm 27 generally vertically upwardly with a negative gradient force, i.e., the force in the direction of movement of end 31 of the arm becomes greater the further upwardly the end 31 is moved. Follower 35 is also adjustably engaged by means, such as adjustment screw 39, for adjusting the force necessary to effect tripping or actuation of toggle device 13, as discussed hereinafter, and the adjustment screw is, in turn, captured in a slot (not shown) provided therefor in frame base 23, as is well known in the art. Upon rotation of adjustment screw 39, follower 35 is moved generally vertically or parallel to frame side wall 25 thereby to bias toggle spring 33 in a manner well known in the art urging arm 27 in an upward or counterclockwise direction about the pivotal engagement of its end 29 with frame side wall 23. It is, of course, understood that adjusting means, such as follower 35 and adjusting screws 37, 39, are disclosed merely for purposes of illustration, and it is contemplated that other adjusting means may be utilized in conjunction with toggle device 13 in an equivalent manner within the scope of this disclosure.

With this arrangement of parts in toggle device 13, toggle spring 33 urges arm 27 upwardly, as seen in FIG. 1, until such time as a net effective force applied on the arm by lever 5 is sufficient to overcome the toggle spring force and pivot the arm downwardly or in a clockwise direction toward a power switching, actuated or displaced position. It will be understood that once the applied force exerted by lever 5 becomes sufficiently great enough to overcome toggle device 13 and begins to pivot arm 27 in the clockwise direction, the decreasing force exerted by toggle spring 33 tends to cause arm 27 to snap through to its displaced position. On the other hand, when the applied force exerted by lever 5 on arm 27 becomes insufficient to maintain the arm in its displaced position, the opposing force of toggle spring 33 will tend to snap the arm upwardly in the counterclockwise direction toward its normal operating or at-rest position. In this manner, snap-action pivotal movement of arm 27 about the pivotal engagement of its end 29 with frame side wall 23 is effected. To complete the description of toggle device 13, means, such as an adjustable actuator, driving connection, or pin 41, for adjusting and driving engagement with movable contact member 17 has its upper end disposed in abutment with the movable contact member and its lower end adjustably or threadedly received in arm 27.

Electrical switch 1 is also provided with an upper housing or cover 43 which is adapted to be mounted to frame 19 by suitable connecting or mounting means (not shown) in a manner well known in the art. A plurality of grooves or recesses 45 are provided in cover 43, and stationary and movable contact members **15–15*e* and 17–17*e* are respectively disposed in the recesses respectively laterally spaced from each other generally in row formation or alignment. Contact members 15, 17 are attached by suitable means well known in the art, such as a plurality of screws 47 for instance, to cover 43, and a pair of electrical contacts 49, 51 are respectively carried by the contact members for circuit making engagement and circuit breaking disengagement. Quick disconnect ends 53, 55 are provided on stationary and movable contact members 15, 17 for respective connection in separate electrical circuits (not shown), and a plurality of openings 57 are provided in cover 43 to accommodate actuator 41 of toggle device 13. Actuator 41 may be adjustably threaded upwardly or downwardly in arm 27 of toggle device 13 for adjustably moving movable contact member 17 relative to stationary contact member 15 to adjust or attain a desired spacing between contacts 49, 51** thereof.

In general and as previously mentioned, electrical switch 1 has a plurality of switching means **3–3*e* adapted to be operated or movable generally sequentially for switching power through the electrical switch. A plurality of conjointly and relatively movable means, such as levers 5–9, are disposed in articulated cascaded relation, as described hereinafter, between switching means 3–3*e*, and at least some of the levers are conjointly movable in response to the applied force thereon relative to at least some of the others thereof for effecting the sequential operation of the switching means. Further, it may also be noted that in their articulated cascaded relation, levers 5–9** are generally aligned in row and tier formation.

More particularly and with reference to FIG. 2, levers 5–9 are illustrated schematically for the purpose of discussing the articulated cascaded relation thereof. Like levers 5, 6 are provided with generally depending, opposite ends or end portions 61, 63 and 65, 67 which are pivotally engaged or jointed in abutment with arms **27, 27*a* and 27*d*, 27*e* of adjacent pairs of toggle devices 13, 13*a*, and 13*d*, 13*e*, respectively. Like levers 7, 8 are disposed in articulated cascaded relation with levers 5, 6, and levers 7, 8 are provided with generally depending, opposite ends or end portions 69, 71 and 73, 75. Ends 69, 75 of levers 7, 8 are pivotally engaged or jointed in abutment with arms 5, 6 generally along the lengths thereof, and ends 71, 73 of levers 7, 8 are pivotally engaged or jointed in abutment with arms 27*b*, 27*c* of an adjacent pair of toggle devices 13*b*, 13*c*, respectively. Lever 9 is disposed in articulated cascaded relation with levers 7, 8, and lever 9 is provided with generally depending, opposite ends or end portions 77, 79 which are pivotally engaged or jointed in abutment with levers 7, 8 generally along the lengths thereof, respectively. It is understood that the pivot points or lines of ends 69, 75 of levers 7, 8 on levers 5, 6 may be any selected length ratio between ends 61, 63 and 65, 67 of levers 5, 6, and this ratio has been selected as 1:1 for purposes of disclosure. Also, the pivot points or lines of ends 77, 79 of lever 9 on levers 7, 8 may also be any selected length ratio between ends 69, 71 and 73, 75 of levers 7, 8, and this ratio has been selected as 2:1 for purposes of disclosure. In this manner, it may be noted that at least a selected portion of the force applied by thermal actuator 11 on levers 5–9 is delivered thereby to the respective switching means 3—3*e*, as discussed hereinafter. Also in order to accommodate the snap-action movement of toggle devices 13–13*e*, at least lever 9 is resilient and will deflect in response to a driving force applied thereto, as discussed hereinafter, and for purposes of disclosure, the other levers 5–8** also have resilient characteristics and will also deflect in response to the applied driving force.

Referring now to FIG. 1, it may be noted that like levers 5, 6 may be formed from generally flat sheet steel or other suitable metal while like levers 7, 8 and also lever 9 are formed from a generally C-shaped channel of steel or other suitable metal. In this manner, levers 5, 6 are guided within the channel section of levers 7, 8, and lever 9 is positioned above levers 7, 8 wherein the levers are disposed and retained generally in both row and tier alignment or formation. Further, each of ends 61–79 of levers 5–9 is provided with a tab or nipple 81 extending therefrom, respectively, and arms **27–27*e* of toggle devices 13–13*e* are slotted at 83–83*e* to receive tabs 81 of levers 5, 6 and one of the tabs 81 of levers 7, 8. Levers 5, 6 are slotted at 85 to receive the other tabs 81 of levers 7, 8, and levers 7, 8 are slotted at 87 to receive tabs 81 of lever 9. In this manner, the interconnection of tabs 81 within their accommodating slots 83–83*e*, 85 and 87 maintains levers 5–9 against displacement from each other and from toggle devices 13–13*e* when assembled in electrical switch 1, as previously described. It may be noted that the interaction of tabs 81 in their respective slots 83–83*e*, 85 and 87 also maintains the articulated cascaded relation of assembled levers 5–9 as well as the preselected points or lines of pivotal engagements of lever ends 61–79**, as previously described.

Means for establishing the driving force, such as thermal actuator 11, is provided in electrical switch 1 and is operable generally for delivering or applying the driving force to means, such as levers 5–9, for distributing such force to effect the sequential actuation of switching means **3–3*e*, as discussed in detail hereinafter. A support or plate 93 of thermal actuator 11 is mounted by suitable means (not shown) to cover 43 of electrical switch 1 so as to dispose an expansible bellows 95 of the thermal actuator above lever 9 generally centrally thereof, and a force transmitting pin or link 97 may be adjustably or threadedly received in lever 9 having its upper end in abutting engagement with the bellows. A standpipe 99 is interposed in pressure fluid communication between bellows 95 and a boiler 101, and means, such as a positive temperature coefficient resistor (PTCR) 103 or the like, for heating the boiler is disposed in heat transfer or conductive relation with the boiler. PTCR 103 is adapted to be connected in an electrical circuit (not shown) for selectively controlling energization and de-energization thereof through leads 105, 107. While thermal actuator 11 of specific design and performance characteristics shown in FIG. 3 is utilized to effect actuation of electrical switch 1** for purposes of this disclosure, it is contemplated that other thermal actuators having other design and performance characteristics may be equivalently employed within the scope of this disclosure.

More particularly with reference to FIG. 3, boiler 101 is formed of a metal having relatively great heat conduction characteristics, as is well known in the art, and is provided with an annular side wall 111 which is tapered at 113 to define an aperture 115 in the lower end of the boiler. A closure member 117 is connected to the upper end of boiler side wall 111 by suitable means, such as soldering or the like as is well known to the art (not shown), and it may be noted that boiler 101 and a vaporiable liquid 119 therein of a type well known to the art presents a relatively small thermal mass compared to the relatively great cooling or surface area thereof. Means, such as PTCR 103, for heating liquid 119 in boiler 101 to effect vaporization thereof is disposed in heat transfer relation with closure member 117, and while the PTCR may be electrically insulated by suitable dielectric material from the closure member if desired, the PTCR is shown mounted in direct heat conductive association with the upper or exterior end of the closure member.

Standpipe or tube 99 is provided with a passage or opening 121 therethrough communicating between boiler 101 and bellows 95, and the standpipe is formed just large enough to allow ready equalization of fluid pressure and small enough to minimize conduction of heat between the boiler and bellows. Standpipe 99 is fixedly disposed by suitable means, such as soldering or the like (not shown), within aperture 115 of boiler 101 and extends into the interior or liquid fill chamber of the boiler so that upper end portion 123 of the standpipe extends a selected space or distance S above a predetermined fill level L of liquid 119 in the boiler. Since upper end portion 123 of standpipe 99 is above or at least generally coextensive with fill level L, transfer of liquid 119 in its liquid state through standpipe passage 121 is obviated. A lower end portion 125 of standpipe 99 extends through cover 43, which generally thermally isolates boiler 101 and bellows 95, into fixed connection with the bellows.

Bellows 3 may be provided with a pair of generally annular, opposite end walls 129, 131 having an annular, expansible, resilient member 133 of relatively low, positive gradient, spring rate fixedly interposed therebetween by suitable means, such as soldering or the like (not shown), and an expansible chamber 135, which is filled completely with liquid 119, is defined within the expansible member between the end walls. Lower end wall 131 is movable in response to expansion of chamber 135 for applying or delivering an output or working force to lever 9 through force transmitting pin 97, and an aperture 137 is provided in upper end wall 33 in which standpipe lower end portion 125 is fixedly received by suitable means such as soldering or the like (not shown). To complete the description of thermal actuator 11, upper end wall 129 of bellows 95 is fixedly secured by suitable means, such as soldering or the like well known in the art (not shown), to plate 93 against displacement therefrom. A more detailed disclosure of thermal actuator 11 and an alternative thermal actuator may be had by referring to copending patent application Ser. No. 433,594 filed Jan. 15, 1974 which is specifically incorporated herein by reference.

In the operation of electrical switch 1, it is assumed that the respective tripping or actuating forces of toggle devices **13–13*e* have been adjusted by adjusting screws 39–39*e*, as previously described, so that the toggle devices will trip sequentially as follows: toggle device 13 first, then 13*a*, 13*b*, 13*e*, 13*d*, and 13*c*. Further, it is also assumed that toggle devices 13–13*e* have been adjusted by adjusting screws 37–37*e***, as previously described, to effect substantially the same force differential for each toggle device, i.e., the differential between the magnitude of the trip force and the force at which reset occurs for each toggle device.

When PTCR 103 is energized by applying power thereto through leads 105, 107 under preselected conditions, heat therefrom is conductively or otherwise transmitted to boiler 101 for heating the boiler and vaporizable liquid 119 therein to the temperature necessary to effect vaporization of the liquid. Upon the vaporization of liquid 119, only vapor is transferred through passage 121 of standpipe 99 toward bellows 95 since upper end 123 of the standpipe extends the preselected space S above the predetermined fill level L of the liquid in boiler 101. Of course, an increase in pressure within boiler 101 predeterminately accompanies the establishment of vapor therein, and communication between the boiler and bellows 95 through passage 121 of standpipe 99 serves to maintain the pressure within the boiler and bellows substantially equalized. Transfer of vapor from boiler 101 to bellows 95 continues until substantially all of liquid 119 has been vaporized, and upon reaching the relatively cooler environs of the thermally isolated bellows 95, the transferred vapor condenses back to the liquid state. In this manner, the condensation of the transferred vapors serves to maintain bellows chamber 135 filled with liquid 119 thereby to compensate for a volumetric increase in the capacity of the bellows chambers when the increased pressure accompanying vaporization of the liquid acts on the effective area of bellows 95 to create a force moving it generally downwardly against lever 9. In view of the foregoing, it may be noted that bellows 95 applies or delivers a variable force of increasing magnitude onto lever 9 for effecting the sequential operation or actuating of switching means **3–3*e***, as described hereinafter.

Assuming toggle devices **13–13*e* have been adjusted, as previously described, so that one set of switching means 3–3*b* is adapted to be sequentially operated prior to the sequential operation of the other set of switching means 3*c*–3*e*, the increasing or variable force applied by bellows 95 generally centrally onto lever is distributed generally evenly between the pair of sets of the switching means 3–3*b* and 3*c*–3*e*. The applied force causes lever 9 to pivot about its end 79 and conjointly moves levers 5, 7 relative to levers 6, 8 for effecting the sequential actuating of switching means 3–3*b*. Due to the lever ratios of levers 5, 7 which were preselected as previously mentioned, the applied force effects generally conjoint pivoting of levers 5, 7 about their ends 63, 71 to effect actuation or displacement movement of arm 27 of toggle device 13 against toggle spring 33 generally downwardly or in the clockwise direction about the pivotal engagement of end 29 of the arm with the frame side wall 23 to the displaced position of the toggle device. Snap-action is imparted to toggle device 13 upon the movement thereof to its displaced position, as previously mentioned, and pin 41 is conjointly movable with arm 27 thereby to permit snap-action resilient movement of movable switch member 17 toward stationary switch member 15 effecting circuit making engagement of contact 51 with contact 49. Once the applied force distributed through levers 5, 7, 9 in their cascaded relation is increased to a value great enough to overcome the opposing force of toggle device 13 and effect the snap-action movement of switching means 3 to its power switching position, as above described, the applied force necessary for maintaining toggle device 13** actuated is predeterminately less than that needed to effect the actuation of the toggle device due to the negative gradient thereof.

As the applied force delivered by thermal actuator 11 to lever 9 increases in value, the increased applied force is distributed through levers 5, 7, 9 in their cascaded relation to effect pivotal movement of lever 5 about its end 61 which, in turn, pivotally moves arm 27*a* generally clockwise against toggle spring 33*a* to actuate toggle device 13*a* and thereby impart snap-action to the movement of movable switch member 17*a* for closing contact 51*a* on contact 49*a*. Upon a further increase in the magnitude of the applied force, lever 7 is conjointly movable with lever 9 and pivotally movable about end 69 of lever 7. The pivotal movement of lever 7 about its end 69 pivotally moves arm 27*b* generally clockwise against toggle spring 33*b* thereby to impart snap-action to the movement of switch member 17*b* for closing contact 51*b* onto contact 49*b*. From the foregoing, it may be noted that levers 5, 7, 9 in their cascaded relation are responsive to increasing magnitude of the force applied by thermal actuator 11 for effecting the sequential operation, movement or actuation of switching means 3–3*b*, and the switching means are generally operable in the same manner since they contain like or similar components.

With the set of switching means 3–3*b* sequentially operated, a further increase in the magnitude of the applied force delivered to lever 9 by thermal actuator 11 effects pivotal movement of the lever about its end 77 to conjointly more levers 6, 8 about their ends 65, 73 to effect actuation or displacement movement of arm 27*e* of toggle device 13*e* against toggle spring 33*e* in the clockwise direction to actuate the toggle device and impart snap-action to the following movement of pin 41*e* and switch member 17*e* for closing contact 51*e* on contact 49*e*. It may be noted that levers 6, 8, 9 in their cascaded relation are conjointly movable relative to levers 5, 7 to actuate switching means 3*e* of the set of the switching 3*c*–3*e*. As the applied force is further increased, lever 6 is further pivotally movable about its end 67 to pivotally move arm 27*d* against toggle spring 33*d* to effect actuation of toggle device 13*d* and impart snap-action to the following movement of pin 41*d* and switch member 17*d* to close contact 51*d* into making engagement with contact 49*d*. A further increase in the magnitude of the applied force effects further pivotal movement of lever 8 about its end 75 to pivotally move arm 27*c* against toggle spring 33*c* to effect actuation of toggle device 13*c* and impart snap-action to the following movement of pin 41*c* and switch member 17*c* to close contact 51*c* onto contact 49*c*. From the foregoing its may be noted that levers 6, 8, 9 in their cascaded relation are generally conjointly movable relative to levers 5, 7 for sequentially operating switching means 3*c*–3*e*, and levers 6, 8, 9 in their cascaded relation are responsive to selected values of the increasing magnitude of the applied force delivered thereto by thermal actuator 11 for effecting the sequential operation of switching means 3*c*–3*e* which also contain similar or like components. It may also be noted that for purposes of disclosure, the set of switching means 3– 3*b* are sequentially operated prior to the set of switching means 3*c*–3*e* by the levers 5–9 in their articulated cascaded relation; however, if desired, any one of switching means 13–13*e* may be preselected for operation in sequence with any other one of the switching means, i.e., a preselection at random.

During reset of thermal actuator 11 under other preselected conditions, PTCR 103 is de-energized to terminate heating of boiler 101, and the boiler begins to cool effecting condensation of a slight amount of vapor therein which results in a corresponding slight decrease in pressure in the boiler. Upon this slight decrease in pressure, the relatively cooler liquid 119 in bellows 95 flows therefrom through passage 121 of standpipe 99 returning to boiler 101 thereby to generally equalize the pressure between the boiler and bellows. This return flow of relatively cool liquid 119 causes immediate additional condensation in boiler 101 by chilling vapor therein thus causing additional return flow of liquid 119 to the boiler. In this manner, the return flow of relatively cool liquid 119 from bellows 95 continues to further cool boiler 101 until the boiler is again filled to its predetermined level L. As pressure in thermal actuator 11 is reduced by the return flow of liquid 119 to boiler 101, as discussed above, the working or applied force is correspondingly reduced and eventually overcome by the forces to toggle springs 33–33*e* acting through levers 5–9. In this manner levers 5–9 and the components of toggle devices 13–13*e* are returned to their original or at-rest positions to effect the opening or disengagement of contacts 51–51*e* from contacts 49–49*e* in a sequence substantially in reverse order of the above described sequential operation of switching means 3–3*e*.

Figure 4:
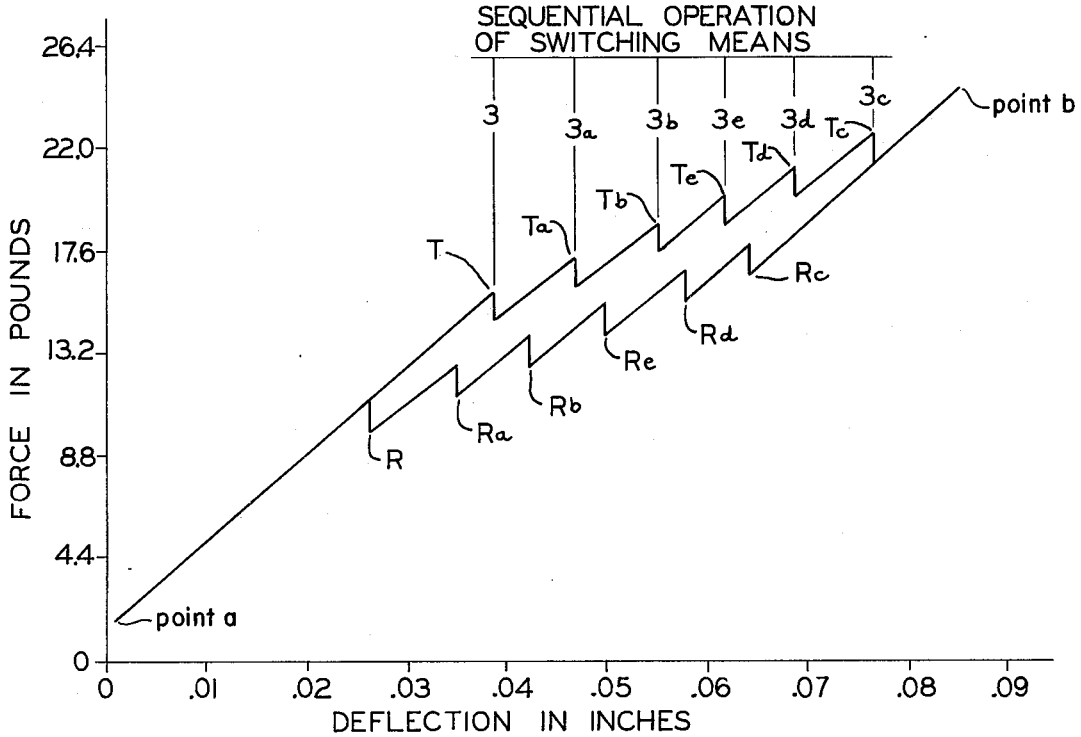
FIG. 4 is a graphical representation illustrating the performance characteristics of the electrical switch of FIG. 1.

Referring now to FIG. 4, a graphical representation of the operating characteristics of electrical switch 1 is shown plotting deflection in inches of articulated cascaded levers 5–9, as measured at lever 9, against the force in pounds applied thereto by thermal actuator 11. Trip forces T–T*e* necessary to effect the sequential actuation or operation of switching means 3–3*e*, as discussed hereinbefore, are compared with reset forces R–R*e* thereof, respectively, It may be recalled that the magnitudes of trip forces T–T*e* were adjustably predetermined with respect to switching means 3–3*e* by adjustably setting adjustment screws 39–39*e*, and the differential between the trip forces and reset forces R–R*e* for the switching means was adjustably predetermined by adjustably setting adjustment screws 37–37*e*, as previously described.

The portion of the curve between point a and trip force T generally represents the increasing magnitude of the force initially applied onto levers 5–9 in their articulated cascaded relation by thermal actuator 11 to effect actuation or operation of switching means 3, as previously described. Upon attainment of trip force T, it may be noted from the curve that the applied force drops rather sharply due to the movement of toggle device 13 from its normal position to its tripped or actuated position. This rather sharp drop in the applied force is effected by the pivotal movement of lever 5 to actuate arm 27 of toggle device 13 against toggle spring 33, and this same sharp drop in force may also be noted as occurring upon the subsequent pivotal movements of levers 5–9 to actuate arms 27*a*–27*e* of toggle devices 13*a*–13*e* against toggle springs 33*a*–33*e* for sequentially operating switching means 3*a*–3*e*, as previously described.

After the sequential actuation of switching means 3*c* and the accompanying sharp drop in the applied force, the applied force may be increased to point *b* on the curve, but upon de-energization of PTCR 103 to effect reset of electrical switch 1 and thermal actuator 11, the applied force is decreased generally along the portion of the curve between point *b* and reset force R*c*. Subsequent to the attainment of reset force R*c*, there is a rather sharp rise in the applied force due to the movement of toggle devices 13–13*e* from their actuated positions, back to their normal or at-rest positions and it may be noted that this sharp rise in the applied force also occurs subsequent to the attainment of each reset force R–R*e*. These increases in the applied force are occasioned by the toggle springs 33–33*e* assisting the release of levers 5–9, i.e., operating in opposition to the applied force, respectively, when toggle devices 13–13*e* are sequentially operated to effect the return of switching means 3–3*e* to their original positions in an order reverse from the sequential operation thereof, as previously described. After resetting of switching means 3, the applied force declines to point *a* on the curve thereby completing a cycle of electrical switch 1 which is now reset for subsequent cyclical operation.

From the foregoing, it is now apparent that a novel electrical switch 1, novel methods for effecting sequential actuation of switching means, and a novel system for making a plurality of separate circuits are provided meeting the objects and advantageous features set out hereinbefore, as well as others, and it is contemplated that changes in the precise configurations, connections and details of the structural components and changes in the precise steps of the methods, which are presented merely to illustrate the invention, may be made by those skilled in the art without departing from the spirit and scope of the invention as set out by the claims which follow.

What I claim as new and desire to secure by Letters Patent of the United States is:

1. In an electrical switch having a plurality of means adapted to be movable generally sequentially for switching power through the electrical switch; and a plurality of movable means adapted to be conjointly and relatively movable and disposed in cascaded articulated relation between the switching means, at least some of the movable means being conjointly movable relative to at least some of the others thereof for effecting the sequential operation of the switching means.

2. In the electrical switch as set forth in claim 1, wherein the movable means includes at least first and second levers drivingly engaged between at least first and second pairs of the switching means, respectively.

3. In the electrical switch as set forth in claim 1, wherein the movable means include at least first and second levers drivingly engaged between at least first and second pairs of the switching means, respectively, one of the first and second levers being movable for sequentially operating the switching means of one of the first and second pairs thereof prior to movement of the other of the first and second levers for sequentially operating the switching means of the other of the first and second pairs thereof.

4. In the electrical switch as set forth in claim 2, wherein the first and second levers respectively include opposite end portions, the opposite end portions being respectively pivotally mounted to associated ones of the switching means of the first and second pairs thereof.

5. In the electrical switch as set forth in claim 2, wherein the first and second levers respectively include opposite end portions respectively pivotally mounted with the switching means of the first and second pairs thereof, the first and second levers being initially pivotally movable about one of their opposite end portions for operating one of the switching means of the first and second pairs thereof and thereafter being further pivotally movable about the other of their opposite end portions for operating the other of the switching means of the first and second pairs thereof.

6. In the electrical switch as set forth in claim 3, wherein the movable means further includes a third lever drivingly engaged between the first and second levers to effect the respective switching means operating movements thereof.

7. In the electrical switch as set forth in claim 2, wherein the movable means further includes third and fourth levers drivingly engaged between the first and second levers and a third pair of the switching means, respectively.

8. In the electrical switch as set forth in claim 2, wherein the movable means further includes third and fourth levers drivingly engaged between the first and second levers and a third pair of the switching means, respectively, the third lever being movable for sequentially operating one of the first lever and one of the switching means of the third pair thereof prior to movement of the fourth lever for sequentially operating one of the second lever and the other switching means of the third pair thereof.

9. In the electrical switch as set forth in claim 7, wherein the third and fourth levers respectively include opposite end portions pivotally mounted to the first and second levers and the switching means of the third pair thereof, the third and fourth levers being pivotally movable about their opposite end portions for operating one of the first lever and the one switching means of the third pair thereof and one of the second lever and the other switching means of the third pair thereof, respectively.

10. In the electrical switch as set forth in claim 7, wherein the movable means further includes a fifth lever for driving engagement with the third and fourth levers.

11. An electrical switch comprising a plurality of means adapted to be generally sequentially movable for switching power through the electrical switch, a plurality of means disposed generally in articulated cascaded relation between the switching means and movable for actuating them generally sequentially, and means for applying a force of varying magnitude under preselected conditions onto the actuating means to effect the switching means actuating movement thereof.

12. An electrical switch as set forth in claim 11, wherein at least some of the actuating means include means respectively engaged with the switching means for distributing at least a portion of the applied force on the actuating means to each of the switching means for effecting the sequential actuation thereof.

13. An electrical switch as set forth in claim 11, wherein the actuating means includes means for respectively interconnecting the actuating means in their cascaded articulated relation so that at least some of the actuating means are conjointly movable relative to at least some of the others thereof during the sequential operation of the switching means.

14. An electrical switch as set forth in claim 11, wherein at least one of the actuating means is generally resilient so as to yield upon the application of the applied force to the actuating means.

15. An electrical switch as set forth in claim 11, wherein the actuating means includes a first lever drivingly engaged between a pair of the switching means, and a second lever drivingly engaged with the first lever to transmit thereto at least a portion of the applied force for effecting the sequential operation of the pair of the switching means.

16. An electrical switch as set forth in claim 15, wherein the second lever includes a portion drivingly engaged with the first lever at a preselected distance generally along the length thereof.

17. An electrical switch as set forth in claim 15, wherein the second lever includes a pair of opposite end portions disposed in operating engagement with the first lever and a third one of the switching means to transmit thereto at least another portion of the applied force for effecting the sequential operation thereof with the pair of the switching means.

18. An electrical switch as set forth in claim 17, wherein the actuating means further includes a third lever drivingly engaged with the second lever generally along the length thereof between the end portions thereof.

19. An electrical switch as set forth in claim 11, further comprising means for preselecting the sequence of the sequential operation of the switching means.

20. An electrical switch as set forth in claim 11, wherein the plurality of switching means constitutes at least a pair of sets of the switching means, and the actuating means being responsive to the applied force thereon for sequentially actuating the switching means of one of the pairs of sets thereof generally prior to actuating the switching means of the other of the pair of sets thereof.

21. A method of generally sequentially actuating a plurality of means for switching power in an electrical switch comprising the steps of:

a. disposing a plurality of means generally in cascading articulated relation between the switching means for actuating them; and b. applying a force established in response to a preselected condition to the actuating means for articulating them in a manner to distribute at least a portion of the force to each of the switching means for effecting the generally sequential actuation thereof.

22. The method as set forth in claim 21, wherein the disposing step comprises spanning at least one of the actuating means between a pair of the switching means with opposite end portions of the one actuating means respectively in pivoting engagement with the pair of switching means and positioning an end portion of another of the actuating means in pivoting engagement with the one actuating means generally along the length thereof.

23. The method as set forth in claim 22, wherein the spanning and disposing step comprises preselecting a distance generally along the length of the one actuating means for the pivoting engagement therewith of the end portion of the other actuating means.

24. The method as set forth in claim 21, wherein the disposing step comprises spanning a pair of the actuating means in pivoting engagement between first and second pairs of the switching means with an end portion of at least another one of the actuating means positioned in pivoting engagement with the pair of actuating means at a preselected distance generally along the lengths thereof.

25. The method as set forth in claim 21, comprising the additional step of releasing the force on the actuating means upon the occurrence of at least another one of the preselected conditions.

26. The method as set forth in claim 21, comprising the additional step of releasing the force on the actuating means under another preselected condition and de-actuating the switching means in a sequence generally reverse to the actuating sequence thereof.

27. The method as set forth in claim 21, wherein the applying step comprises increasing pressure within an expansible container for delivering the force to the actuating means by vaporizing a vaporizable liquid in the container.

28. The method as set forth in claim 27, wherein the increasing step comprises heating the container to effect the vaporizing of the liquid therein.

29. The method as set forth in claim 21, comprising the preliminary step of adjusting a plurality of means respectively associated with the switching means for predetermining the sequence of actuation of the switching means.

30. The method as set forth in claim 21, comprising the intermediate step of adjusting a plurality of means respectively associated with the switching means for predetermining the sequence of actuation of the switching means.

31. A method of actuating a pair of sets of a plurality of means under preselected conditions for respectively switching power generally in sequence in an electrical switch comprising the steps of:

a. establishing a variable force in response to the occurrence of at least one of the preselected conditions; and b. distributing the variable force for sequentially actuating the plurality of switching means in one set thereof prior to sequentially actuating the plurality of switching means in the other set thereof.

32. The method as set forth in claim 31, wherein the distributing step further comprises applying the variable force to a plurality of means for actuating the switching means of the sets thereof, the actuating means being disposed generally in cascaded articulated relation between the switching means of the sets thereof.

33. The method as set forth in claim 32, wherein the applying step comprises moving the actuating means in response to the variable force for sequentially actuating the switch means of one of the one and other sets thereof generally prior to the sequential actuating of the switching means of the other of the one and other sets thereof.

34. The method as set forth in claim 31, comprising the additional step of releasing the variable force upon the occurrence of at least another one of the preselected conditions.

35. The method as set forth in claim 31, comprising the additional step of releasing the variable force upon the occurrence of at least another one of the preselected conditions and de-actuating the switching means of the sets thereof in a sequence reverse to the actuation sequence thereof.

36. The method as set forth in claim 31, wherein the establishing step comprises vaporizing a vaporizable liquid and increasing the pressure within an expansible container therefor for delivering the variable force.

37. The method as set forth in claim 36, wherein the vaporizing step comprises heating the container for effecting the vaporizing of the liquid therein.

38. In a system having a plurality of separate circuits, and a plurality of means for respectively making the separate circuits to energize them generally sequentially; the combination therewith comprising means for establishing a generally increasing force under preselected conditions, and a plurality of means disposed in cascaded articulated relation with each other and driven in response to the increasing force for predeterminately distributing at least portions thereof to preselected ones of the circuit making means thereby to effect the generally sequential energization of the circuits.

39. A system as set forth in claim 38, wherein at least some of the circuit making means include means for imparting snap-action thereto upon the movement thereof to the power switching positions.

40. A system as set forth in claim 39, wherein at least some of the distributing means are resilient to accommodate the snap-action movement of the circuit making means.

41. A system as set forth in claim 38, further comprising means adjustably engaged with associated ones of the circuit making means for preselecting the sequence of actuation thereof.

42. A system as set forth in claim 38, wherein the distributing means comprises a first lever pivotally engaged between a pair of the circuit making means, and a second lever pivotally engaged with the first lever generally along the length thereof for imparting thereto at least a portion of the force to effect the sequential actuation of the pair of the circuit making means.

43. A system as set forth in claim 42, wherein the second lever is also pivotally engaged with a third one of the circuit making means for also imparting thereto at least a portion of the force to effect the actuation thereof in sequence with the pair of the circuit making means.

44. A system as set forth in claim 43, wherein the distributing means further comprises a third lever pivotally engaged with the second lever generally along the length thereof and engaged with the force establishing means.

45. A system as set forth in claim 38, wherein the circuit making means include first and second sets thereof, and at least some of the distributing means being driven relative to other thereof for effecting the sequential actuation of the circuit making means in one of the first and second sets thereof prior to the sequential actuation of the circuit making means in the other of the first and second sets thereof.

* * * * *